US006729984B2

(12) United States Patent
Silverglate

(10) Patent No.: US 6,729,984 B2
(45) Date of Patent: May 4, 2004

(54) TOY BALL APPARATUS

(75) Inventor: David Silverglate, Santa Cruz, CA (US)

(73) Assignee: Rhino Toys, Inc., Santa Cruz, CA (US)

( * ) Notice: Subject to any disclaimer, the term of this patent is extended or adjusted under 35 U.S.C. 154(b) by 0 days.

(21) Appl. No.: 10/183,925

(22) Filed: Jun. 25, 2002

(65) Prior Publication Data

US 2003/0022588 A1 Jan. 30, 2003

Related U.S. Application Data

(60) Provisional application No. 60/308,502, filed on Jul. 28, 2001.

(51) Int. Cl.[7] ..... A63B 39/00
(52) U.S. Cl. ..... 473/612; 273/157 R
(58) Field of Search ..... 273/157 R, 156; 473/280, 612, 607, 596; 434/208

(56) References Cited

U.S. PATENT DOCUMENTS 3,046,016 A 7/1962 Laws
3,691,704 A * 9/1972 Novak ..... 273/157 R
3,889,950 A 6/1975 Kasravi
3,959,937 A 6/1976 Spunt
4,309,852 A * 1/1982 Stolpin ..... 52/DIG. 10
4,637,941 A 1/1987 Rochte
4,813,674 A 3/1989 Lorhpipat
4,836,787 A * 6/1989 Boo ..... 52/DIG. 10
5,104,125 A * 4/1992 Wilson ..... 273/157 R
5,224,959 A 7/1993 Kasper
5,236,196 A 8/1993 Blankenburg et al.
5,411,262 A * 5/1995 Smith ..... 273/157 R
6,418,673 B1 7/2002 Flowerday

OTHER PUBLICATIONS

Fig. No. 62 of "bicycle wheel" dome, from Edward Popko, *Geodesics*, (University of Detroit Press, 1968.
Hol–ee Roller toy.
Grab Ball toy.

* cited by examiner

*Primary Examiner*—Steven Wong
(74) *Attorney, Agent, or Firm*—Kolisch Hartwell, P.C.

(57) ABSTRACT

Toy apparatus are provided. One embodiment of the apparatus includes a mesh having a plurality of loop structures with cooperative mating surfaces located around the perimeter of the loop structures. The loop structures form a surface of the apparatus when the cooperative mating surfaces are coupled with each other.

41 Claims, 4 Drawing Sheets

TOY BALL APPARATUS

CROSS-REFERENCE TO RELATED APPLICATIONS

This application claims priority under 35 U.S.C. §119 to U.S. Provisional Application Serial No. 60/308,502, entitled "Amusement Device With Mesh Structure," which was filed on Jul. 28, 2001, the entire disclosure of which is hereby incorporated by reference.

BACKGROUND OF THE INVENTION

Balls are one of the oldest types of toys and sports equipment. Many popular games involve rolling, passing, kicking, tossing, catching, bouncing, or hitting balls. For children who are just developing motor control, for those who may have some motor control dysfunction, as well as for many who simply enjoy such activities, it is often difficult and/or frustrating to handle various available throwing and catching devices, such as balls. One of the problems with many conventional balls is that they are sometimes painful to catch and/or hold. Another problem is that conventional balls do not offer a surface configuration that promotes quick, sure gripping, making them difficult to catch and/or hold.

Prior devices intended to address at least some of these concerns, such as the "GrabBall", commercially available from Sportime of Atlanta, Ga., and the geodesic ball shown in U.S. Pat. No. 3,889,950, suffer from drawbacks such as angular holes with sharp corners and discontinuities and/or couplers where two hemispheres (or halves) are joined to form the respective balls. These aspects result in those apparatus being difficult to grasp and/or to catch when thrown, as well as being aesthetically unpleasing and non-resilient. A further drawback of such apparatus is that the holes of these balls are not appropriately sized to receive the fingers of a person using such balls.

Another prior device is the "Hol-ee Roller" dog chew toy commercially available from JW Pet Company, Inc. of Hasbrock Heights, N.J. This chew toy suffers from drawbacks similar to those discussed above, as it includes angular holes with sharp, uncomfortable edges resulting from discontinuities where inner and outer mold halves meet due to mold clearances and undercuts. Additionally, this chew toy is molded in one piece, and, therefore, can have only one color, which makes it aesthetically unpleasing. Furthermore, this device does not bounce well and has a relatively poor strength to weight ratio. This poor strength to weight ratio is due, at least in part, to the fact that stress on the structure of this device is not well distributed due to the angular holes requiring the device to be relatively thick in order to tearing at the hub-to-strut joints. Based on the foregoing, alternative toy ball structures that overcome at least some of the current drawbacks may be desirable.

SUMMARY OF THE INVENTION

Toy apparatus are provided, where the apparatus include a mesh having a plurality of loop structures with cooperative mating surfaces located around the perimeter of the loop structures. The loop structures form a surface of the apparatus when the cooperative mating surfaces are coupled with each other.

DETAILED DESCRIPTION OF THE PREFERRED EMBODIMENTS

Figure 1:
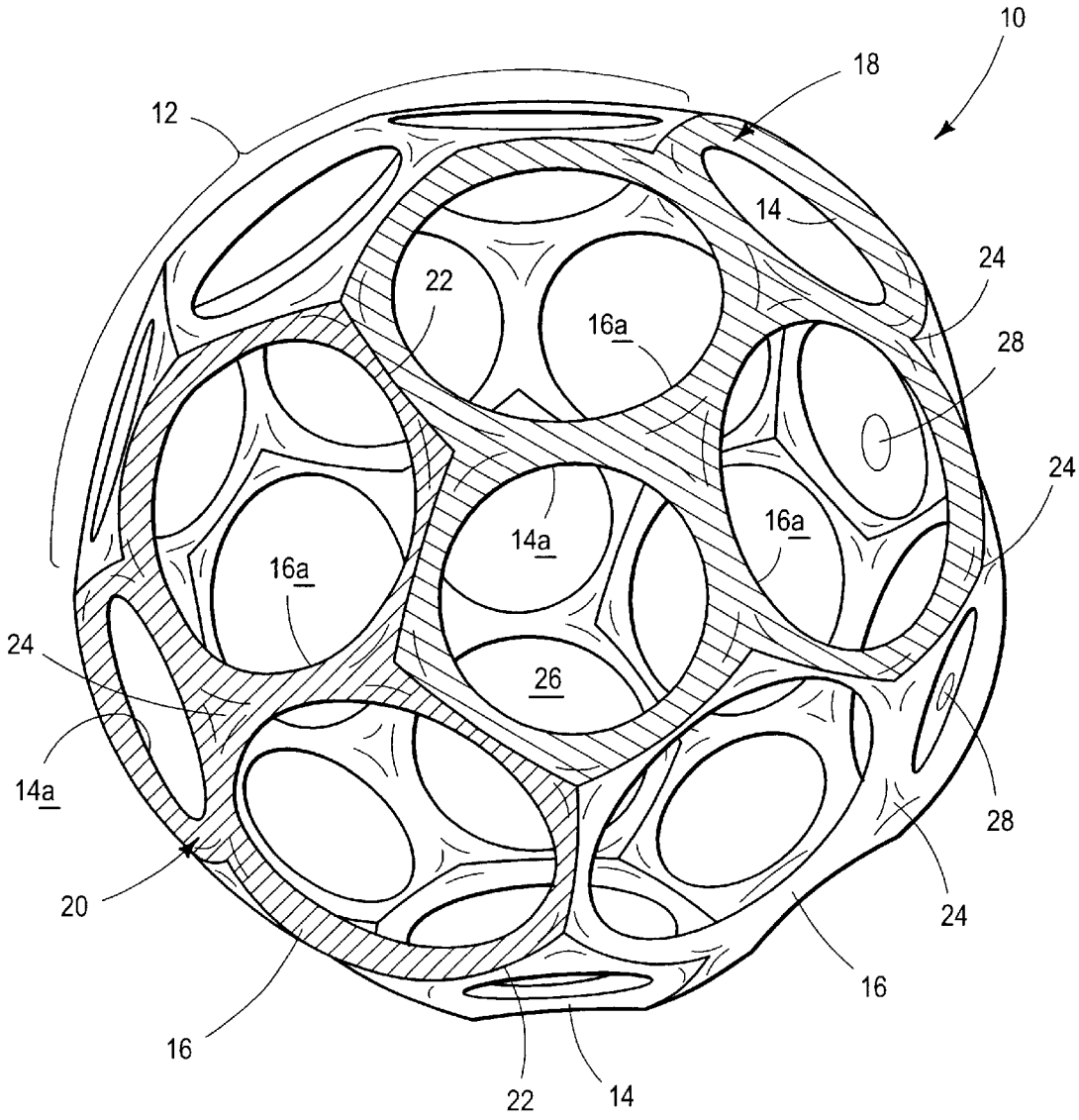
FIG. 1 is an isometric view of a ball according to an embodiment of the invention, wherein the backside, bottom left of the ball is a substantial mirror image of the front side, top right.

FIG. 1 is an isometric view of a toy ball apparatus 10 according to an embodiment of the invention. Ball 10 may include a surface that is formed by a mesh 12. Mesh 12 may be formed from a plurality of differently sized loop structures 14 and 16. For this embodiment, loop structures 14 may be relatively smaller than loop structures 16. Loop structures 14 and 16 may be appropriately sized to receive the fingers of a user's hand, such as a child's hand. Loop structures 14 and 16 typically may be continuously curved on their inside surface (14*a* and 16*a*, respectively) and, therefore, contain no angular portions that may be uncomfortable when ball 10 is grasped and/or thrown by a user.

A plurality of loop structures 14 and 16 also may be included in loop structure assemblies 18 and 20. For this embodiment, loop structure assembly 18 may be termed a "four-loop assembly", while loop structure assembly 20 may be termed a "three-loop assembly." In this respect, loop structure assembly 18 may include two smaller loop structures 14 and two larger loop structures 16, while loop structure assembly 20 may include one smaller loop structure 14 and two larger loop structures 16. It will be appreciated that any subset of loop structures 14 and 16 of ball 10 may be included in loop structure assemblies, such as loop structure assemblies 18 and 20.

Ball 10, as shown in FIG. 1 and previously indicated, may be formed using loop structures 14 and 16 (hereafter "structures") and/or loop structure assemblies 18 and 20 (hereafter "assemblies"). It will be appreciated that the use of loop structure assemblies may reduce the number of component parts for ball 10. Such a reduction in component parts may reduce manufacturing complexity and, as a result, reduce manufacturing costs. In forming ball 10, each component part may be affixed to one or more adjacent component parts using an adhesive, or any number of appropriate fastening techniques. Seams 22, also referred to as joints 22, may be formed between adjacent component parts when they are affixed to each other. The structure of mesh 12 may help distribute stress over ball 10 when it is stretched or deformed, thereby reducing stress on seams 22 and loop structures 14, 16. This is because the loop structures, and the absence of any angular holes or sharp corners, may allow such stresses to be distributed over the surface of ball 10, improving its overall strength and in particular, reducing the possibility of tearing.

Within assemblies 18 and 20, as well as at intersections of seams 22, ball 10 may include web structures 24 that are interstitially located between structures 14 and 16, and assemblies 18 and 20 of ball 10. Web structures 24 may further improve the strength, durability and resiliency of ball 10, as they may, in conjunction with mesh 12, distribute stress over the surface of ball 10 when it is stretched or deformed. Additionally, within assemblies 18 and 20, structures 14 and 16 may form substantially circular finger-receiving open spaces 28, which may be used to grip, stretch, throw and/or catch ball 10.

Structures 14 and 16, and assemblies 18 and 20 may be formed from a variety of materials, such as various plastic or polymer materials. For example, structures 14 and 16, and assemblies 18 and 20 may be formed of thermoplastic using an injection molding process. Structures 14 and 16 and/or assemblies 18 and 20, once molded, may be assembled to form ball 10, as shown in FIG. 1. Also, because structures 14 and 16 and assemblies 18 and 20 may be individually molded, each component part of ball 10 may be of a different color material, if desired, which may improve the aesthetic appearance of ball 10. Because there is substantially more open space than structure in ball 10 and because it has a high strength-to-weight ratio, especially in tension, only a small amount of material need be used in order to define a ball-like shape, which decreases the cost of manufacture.

Ball 10 (e.g. structures 14 and 16, and/or assemblies 18 and 20) may be formed of materials that result in ball 10 being substantially deformable, as well as substantially resilient or rigid. In this respect, ball 10 may be formed of plastic or polymer materials having a shore "A" hardness of between approximately 50 and 150. As a result, ball 10 may be at least partially deformed into a space 26, also referred to as closed volume 26, surrounded by mesh 12. Typically, once a force, or object, causing such deformation is removed from ball 10, the resilient character of mesh 12 results in ball 10 substantially returning to its original shape. Due to mesh 12 being substantially deformable and substantially resilient, ball 10 may bounce when thrown against an object or impediment. Such deformability and resiliency of ball 10 may also make it more comfortable to catch and throw as compared to prior devices. The resiliency of ball 10 may be varied by using materials of different shore hardness, as was previously noted. Such variations may provide for manufacturing a competition-type sports ball, such as a soccer ball, that would not require inflation, as well as a highly deformable and resilient structure. A first portion of the mesh may be formed of a first hardness and a second portion of the mesh may be formed with a second hardness. The mesh may be used to form, for example, a dual stiffness toy apparatus such as a baseball bat with a handle that is stiffer than the head of the bat.

Ball 10 may form a polyhedron shape such as a truncated icosahedron (an approximate soccer ball shape, as shown in FIG. 1). Further, ball 10 may approximate a sphere in cross-section, or on an axis of rotation. It will be appreciated that other polyhedron shapes may be formed, such as tetrahedrons, icosahedrons, icosadodecahedron or dodecahedrons. Alternatively, other non-polyhedron shapes may be formed using structures 14 and 16, and/or assemblies 18 and 20, such as ovoids, animal shapes, baseball bats, sports racquets, organic shapes, and/or basketball nets, among many other possible configurations.

Figure 2:
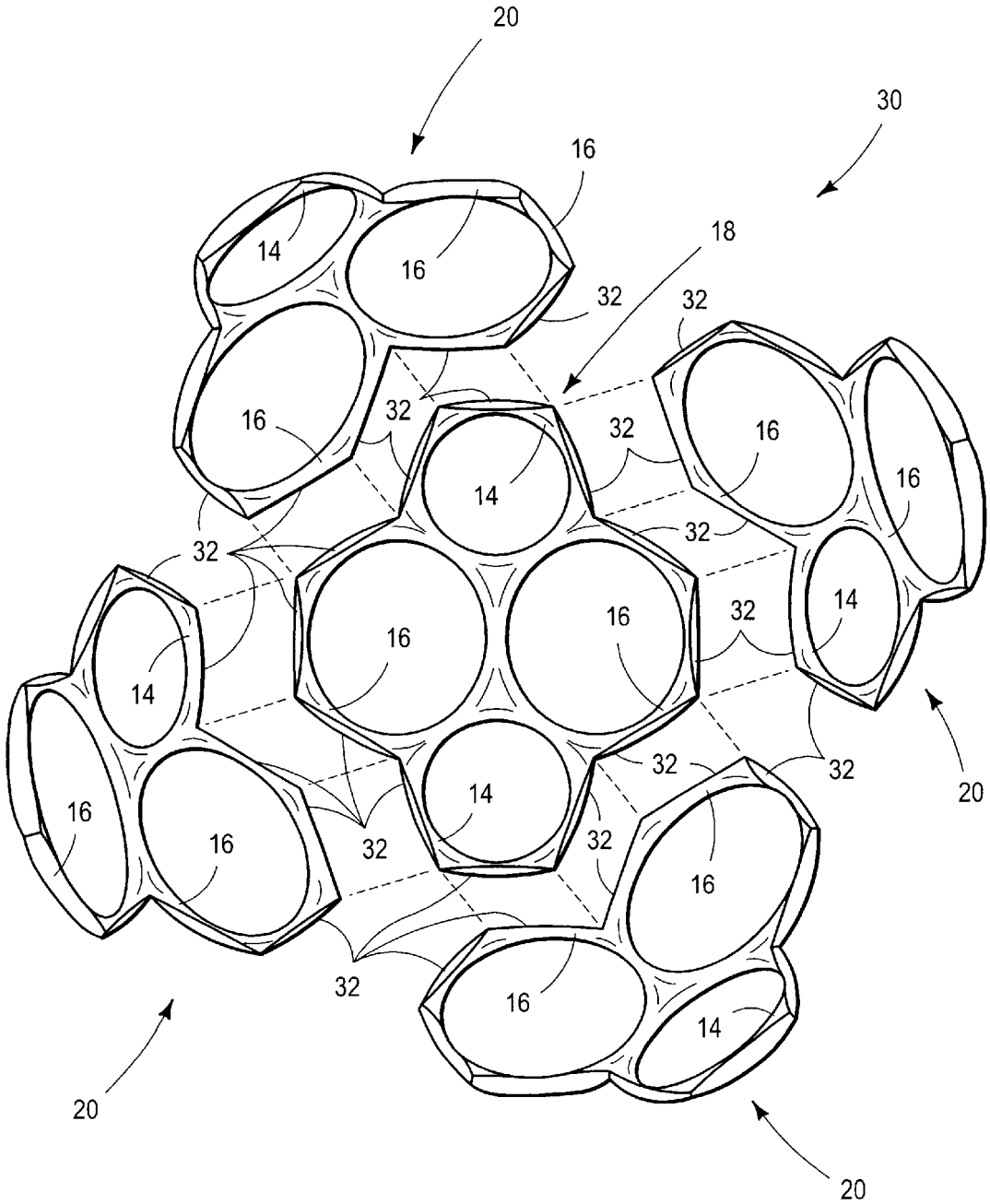
FIG. 2 is an exploded, perspective view of an approximate hemisphere of the ball illustrated in FIG. 1, showing various sub-components.

Referring to FIG. 2, an exploded view of an approximate hemisphere of ball 10 is indicated generally at 30. Hemisphere 30 may include one four-loop structure assembly 18 and four two-loop structure assemblies 20, which may include cooperative mating surfaces 32. Mating surfaces 32 may be arranged around the perimeter of assemblies 18 and 20. Mating surfaces 32 also may be congruent and substantially planar. Alternatively, mating surfaces 32 may be complimentarily convex and concave in configuration, or any number of other complimentary surface configurations.

However, it may be desirable that assemblies 18 and 20 be of a configuration that is relatively easy to tool for molding, such as injection molding. In this regard, it may be desirable to reduce the number of undercuts, as well as limit the curvature in such molds. Such measures may reduce the likelihood that assemblies 18 and 20 become damaged when ejected from their molds without significantly increasing tooling cost for such molds, such as associated with sliding portions of such molds.

Figure 5:
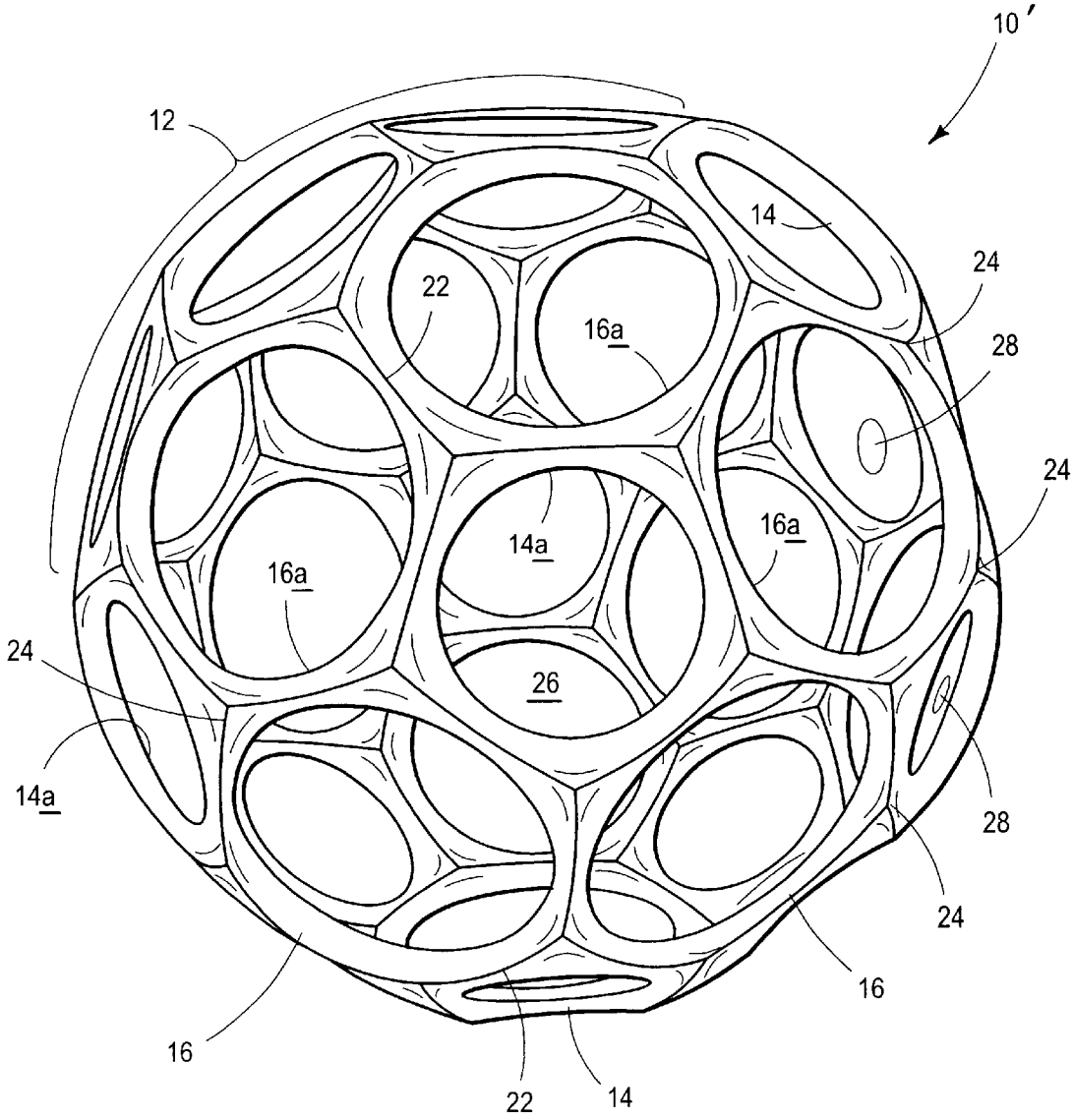
FIG. 5 is an isometric view of a ball according to another embodiment of the invention, wherein the backside, bottom left of the ball is a substantial mirror image of the front side, top right.

A single assembly 18, and four assemblies 20 may be affixed together along mating surfaces 32, as indicated in FIG. 2, to form approximate hemisphere 30 of ball 10. Two hemispheres 30 may then be affixed along mating surfaces 32 to form ball 10. In this regard, ball 10 may include two assemblies 18 (which may be termed "ends") and eight assemblies 20 (which may be termed "sides"). Alternatively, as illustrated in FIG. 5, twelve loop structures 14 and twenty loop structures 16 may be used to form ball 10', with each loop structure 14 and 16 including mating surfaces 32 around its perimeter. However, as was indicated earlier, it may be desirable to reduce the number of individual components included in ball 10, so as to reduce manufacturing complexity.

Loop structures 14 may include mating surfaces 32 that are pentagonal in arrangement, while loop structures 16 may include mating surfaces 32 that are hexagonal in arrangement (such as shown in FIG. 2). It will be appreciated that many other configurations are possible. For example, structures 14 may include mating surfaces that are square in arrangement and loop structures 16 may include mating surfaces that are octagonal in arrangement, or any other compatible polygonal arrangements may be used. In such a configuration, structures 14 and 16 may still include continuously curved inner surfaces 14*a* and 16*a* that include no angular portions so as to be comfortable for gripping, catching and/or throwing, as well as better distributing forces and stress over the surface of ball 10.

Figure 3:
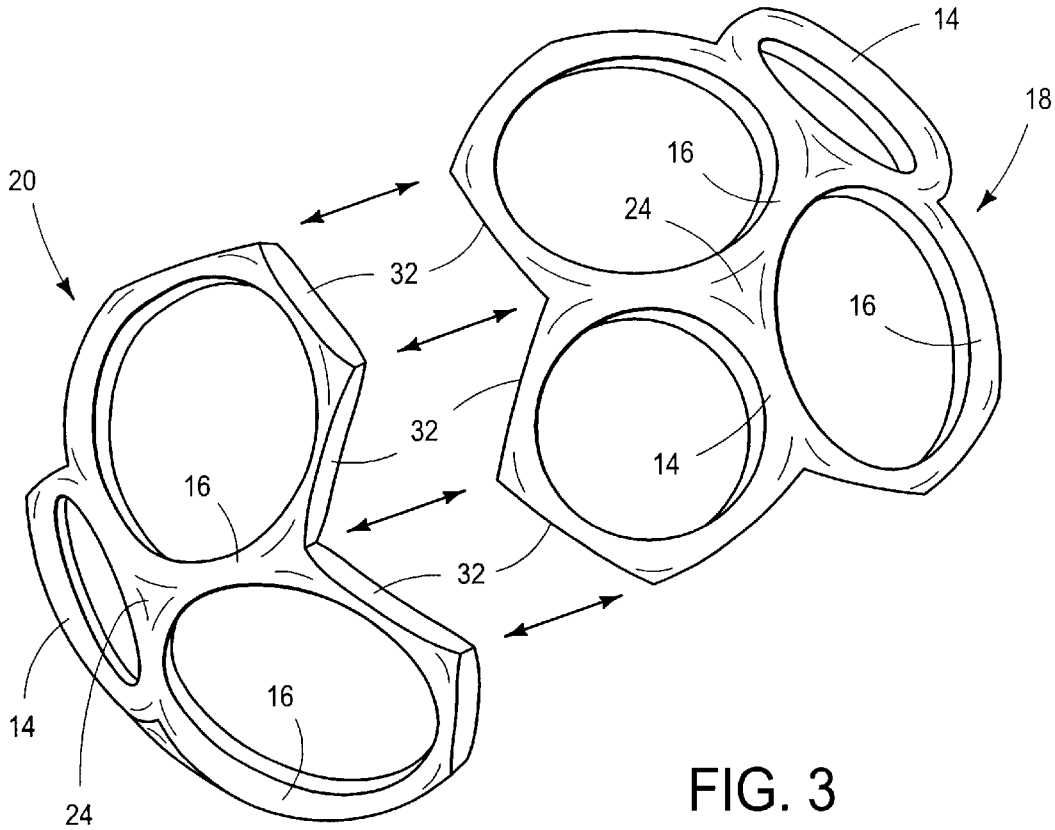
FIG. 3 is a more detailed isometric, exploded view of two sub-components of the ball illustrated in FIG. 1.
Figure 4:
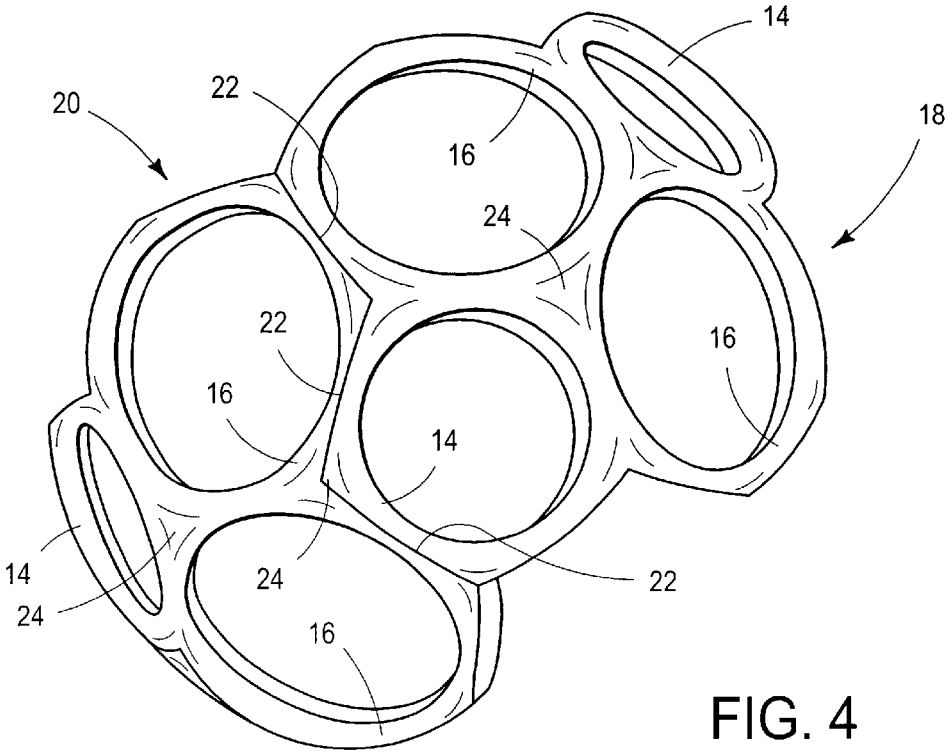
FIG. 4 is an isometric view of the two sub-components illustrated in FIG. 3 viewed as assembled.

Referring to FIGS. 3 and 4, a more detailed view of the assembly of assembly 18 with assembly 20 is shown. In FIG. 3, arrows indicate how assembly 18 and assembly 20 may be mated at cooperative mating surfaces 32 when forming mesh 12 of ball 10. Interstitial web structures 24 are formed within assemblies 18 and 20. Referring to FIG. 4, assembly 18 and assembly 20 are affixed with each other at mating surfaces 32. Seams 22 are formed between assembly 18 and assembly 20 (along mating surfaces 32). At the intersection of seams 22, additional web structures 24 are formed as a result of affixing assembly 18 with assembly 20.

While ball 10 has been described above, an alternative way of describing ball 10, with reference to FIGS. 1 and 2, is as follows. Ball 10 may include an elastic mesh structure 12 formed from plural elongate strands 14 and 16. Mesh structure 12 may also include joinder regions 32 uniting adjacent strands 14 and 16 to form, as viewed in developed form, plural closed-perimeter open spaces 28 including such spaces 28 which are defined, substantially completely throughout their perimeters, by curved perimeter surfaces 14 and 16, or endless-loop curved surfaces. The curved perimeter surfaces 14 and 16 may be, with elastic deformation of the mesh 12, permitted to flex so as selectively, and depending upon the character of deformation, to increase or decrease with regard to local radius of curvature. Further, mesh 12 may be characterized as having substantial radial symmetry within its pattern. Each closed-perimeter open space 28 and joinder region 32 typically includes a central zone, and each is characterized, relative to its central zone, by substantial radial symmetry within the pattern.

The invention may also be described as a toy apparatus 10, including a plurality of substantially deformable smooth loops 14, 16, one or more of the loops being closed, and a plurality of mating surfaces 32 disposed perimetrically around at least a portion of each loop, for coupling the loops with one another, wherein the plurality of loops 14, 16, when coupled, form a resilient mesh 12, which defines a surface. The loops may be differently sized so as to provide for curving the surface, to form a spherical ball, or a polyhedron such as a truncated icosahedron, tetrahedron, icosahedron, icosadodecahedron or dodecahedron.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and sub-combinations of the various elements, features, functions, and/or properties disclosed herein. The following claims define certain combinations and sub-combinations of features, functions, elements, and/or properties that are regarded as novel and non-obvious. Other combinations and sub-combinations may be claimed through amendment of the present claims or presentation of new claims in this or a related application. Such claims, whether they are broader, narrower, equal, or different in scope to any earlier claims, also are regarded as included within the subject matter of the invention.

I claim:

1. A toy apparatus having a surface, the apparatus comprising:

a mesh including a plurality of loop structures having cooperative mating surfaces disposed at least partially around an outer perimeter of each loop structure, wherein the loop structures have curved inside perimeter surfaces, and wherein the cooperative mating surfaces of adjacent loop structures are configured to couple together for a distance along their lengths, wherein the loop structures form the surface of the toy when the cooperative mating surfaces are coupled with each other.

2. The toy apparatus of claim 1, wherein the mesh is substantially deformable.

3. The toy apparatus of claim 2, wherein the mesh is substantially resilient.

4. The toy apparatus of claim 3, wherein the toy apparatus, due to the substantially deformable and substantially resilient mesh, is configured to substantially bounce as a result of striking an impediment.

5. The toy apparatus of claim 1, wherein the surface defines a closed volume.

6. The toy apparatus of claim 5, wherein the closed volume defined by the surface approximates a ball.

7. The toy apparatus of claim 1, wherein the surface is substantially spherical.

8. The toy apparatus of claim 1, wherein the surface is a polyhedron.

9. The toy apparatus of claim 8, wherein the polyhedron is selected from the group consisting of truncated icosahedron, tetrahedron, icosahedron, icosadodecahedron and dodecahedron.

10. The toy apparatus of claim 1, wherein the inside perimeter surfaces of the loops are continuously curved.

11. The toy apparatus of claim 10, wherein the inside perimeter surfaces of the loops are circular.

12. The toy apparatus of claim 1, wherein the loop structures include a first loop size having pentagonal shaped mating surfaces and a second loop size having hexagonal shaped mating surfaces.

13. The toy apparatus of claim 12, wherein the first loop size is relatively smaller than the second loop size.

14. The toy apparatus of claim 13, further comprising:

one or more first loop structure assemblies having two loops of the first loop size and two loops of the second loop size; and one or more second loop structure assemblies having one loop of the first loop size and two loops of the second loop size.

15. The toy apparatus of claim 14, wherein the surface forms a ball that includes two first loop structure assemblies, each coupled with four second loop structure assemblies to form a first approximate hemisphere and a second approximate hemisphere of the ball, the first and second hemispheres being coupled with each other to form the ball.

16. The toy apparatus of claim 14, wherein the first and second loop structure assemblies are formed using an injection molding process, wherein web structures are formed interstitially between loops included in the first and second loop structure assemblies.

17. The toy apparatus of claim 1, wherein the mesh is formed of material having a shore "A" hardness between approximately 50 and 150.

18. The toy apparatus of claim 1, wherein the cooperative mating surfaces are congruent.

19. The toy apparatus of claim 1, wherein the cooperative mating surfaces are planar.

20. The toy apparatus of claim 1, wherein a cross-section of the loop structures is substantially circular.

21. A toy apparatus comprising:

a plurality of loop structures having substantially planar cooperative mating surfaces disposed at least partially about an outside perimeter of each loop structure, wherein the loop structures, when coupled with each other form a surface which defines a volume, each of the loop structures including a curved inside perimeter surface defining a curved finger-receiving void in the surface.

22. The toy apparatus of claim 21, wherein a ratio of an outer surface area of the mesh to finger-receiving void is less than one third.

23. The toy apparatus of claim 21, wherein a ratio of an outer surface area of the mesh to finger-receiving void is less than one sixth.

24. The toy apparatus of claim 21, wherein the cooperative mating surfaces form a web structure between adjacent loop structures.

25. The toy apparatus of claim 21, wherein the loop structures include differently sized loop structures.

26. The toy apparatus of claim 21, further comprising:

one or more loop structure assemblies, the loop structure assemblies each including one or more of the differently sized loop structures.

27. A toy apparatus, comprising:

a resilient mesh including a plurality of linked loops defining a surface, each loop being continuously curved having no angular portions, such that a user's fingers may extend through the loops, and grasp two or more of the loops in a gripping motion to secure a grip on the mesh without contacting any angular portions, wherein the loops include curved inside perimeter surfaces and substantially planar mating surfaces around at least a portion of an outside perimeter of each loop.

28. The apparatus of claim 27, wherein the mesh surrounds a closed volume to create a three dimensional structure.

29. The apparatus of claim 27, wherein the mesh is formed in the shape of a ball.

30. The apparatus of claim 27, wherein the mesh is substantially spherical.

31. A toy apparatus, comprising:

a plurality of substantially deformable smooth loops having no corners, one or more of the loops being closed; and a plurality of substantially planar mating surfaces disposed perimetrically around at least a portion of each loop, for coupling the loops with one another, wherein the plurality of loops, when coupled, form a resilient mesh, which defines a surface.

32. The toy apparatus of claim 31, further comprising a web structure between coupled loops.

33. The toy apparatus of claim 31, wherein the loops are differently sized so as to provide for curving the surface.

34. The toy apparatus of claim 31, wherein the surface defines a closed volume.

35. The toy apparatus of claim 31, wherein the mesh forms a ball.

36. The toy apparatus of claim 31, wherein the mesh is substantially spherical.

37. The toy apparatus of claim 31, wherein the mesh forms a polyhedron shape.

38. The toy apparatus of claim 37, wherein the polyhedron is selected from the group consisting of truncated icosahedron, tetrahedron, icosahedron, icosadodecahedron and dodecahedron.

39. An elastic mesh structure, comprising:

plural elongate strands; and joinder regions uniting adjacent strands to form, as viewed in developed form, plural closed-perimeter open spaces including such spaces which are defined, substantially completely throughout their perimeters, by curved inner perimeter surfaces which, with elastic deformation of the mesh are permitted to flex so as selectively, and depending upon the character of deformation, to increase or decrease with regard to local radius of curvature, wherein adjacent strands include cooperative mating surfaces that are joined together for a distance in the joinder regions.

40. An elastic mesh structure, comprising:

plural elongate strands; and joinder regions uniting adjacent strands to form, as viewed in developed form, plural closed-perimeter open spaces including such spaces which are defined, substantially throughout their inner perimeter, by endless-loop curved inner surfaces in the associated strands, wherein adjacent strands include cooperative mating surfaces that are joined together for a distance in the joinder regions.

41. An elastic mesh structure, comprising:

plural elongate strands; and joinder regions uniting adjacent strands to form, as viewed in developed form, a pattern of adjacent closed-perimeter open spaces bounded by curved inner perimeter surfaces of the strands, and strand-joinder-regions adjacent the spaces, each space and region having a central zone, and each being characterized, relative to its central zone, by substantial radial symmetry within the pattern, wherein adjacent strands include cooperative mating surfaces, each mating surface formed on an opposite side of the strand from a curved inner surface of the strand, the cooperating mating surfaces being joined together for a distance in the joinder regions.

* * * * *